United States Patent [19]

Rosenberg et al.

[11] 4,261,515

[45] Apr. 14, 1981

[54] ROTARY SPRINKLER

[76] Inventors: Peretz Rosenberg; Avner Rosenberg, both of Moshav Beit Shearim, Israel

[21] Appl. No.: 108,296

[22] Filed: Dec. 28, 1979

[51] Int. Cl.[3] ..... B05B 3/04

[52] U.S. Cl. ..... 239/222.17; 239/381; 239/515

[58] Field of Search ..... 239/380–383, 239/453, 454, 461, 499, 506, 514, 515, DIG. 1, DIG. 16, DIG. 20, 222.17

[56] References Cited

U.S. PATENT DOCUMENTS

| | | | |
|---|---|---|---|
| 1,112,416 | 9/1914 | Sargent | 239/453 |
| 1,764,570 | 6/1930 | Lohman | 239/524 |
| 2,584,661 | 2/1952 | Barker et al. | 239/514 |
| 3,034,728 | 5/1962 | Hruby, Jr. | 239/DIG. 16 |
| 3,069,099 | 12/1962 | Graham | 239/453 |
| 3,958,760 | 5/1976 | Rosenberg | 239/453 |

FOREIGN PATENT DOCUMENTS

| | | | |
|---|---|---|---|
| 120631 | 1/1948 | Sweden | 239/506 |

*Primary Examiner*—Robert B. Reeves
*Assistant Examiner*—Michael J. Forman
*Attorney, Agent, or Firm*—Benjamin J. Barish

[57] ABSTRACT

A rotary sprinkler is described comprising a nozzle formed with an axial bore, a spindle extending through the bore and including stops at its opposite ends, and a rotor floatingly mounted on the spindle for rotary and axial movement thereon by the liquid jet issuing from the nozzle bore, the spindle being also axially and laterally movable within the bore such that the rotation of the rotor by the jet self-centers it on the spindle and also self-centers the spindle in the nozzle bore.

10 Claims, 3 Drawing Figures

Fig. 1
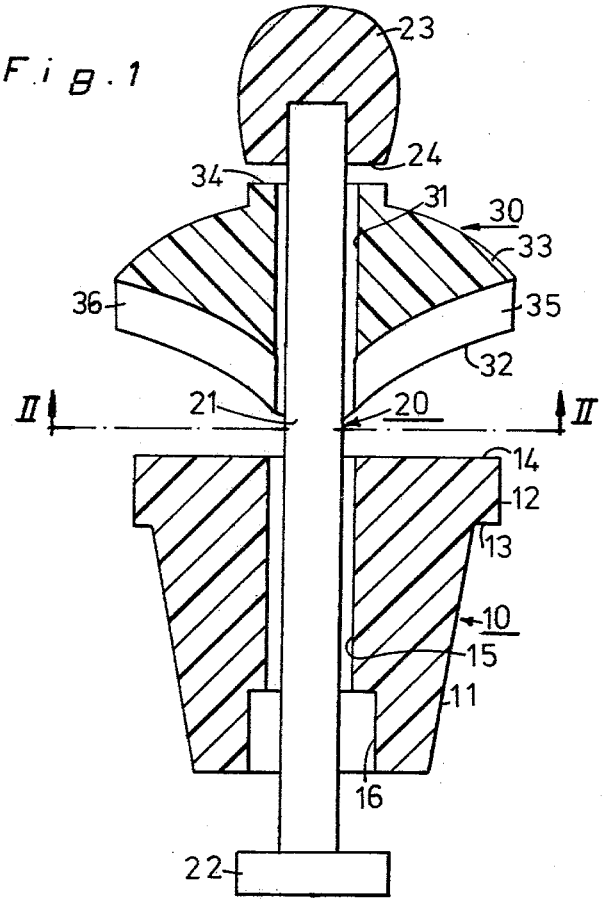
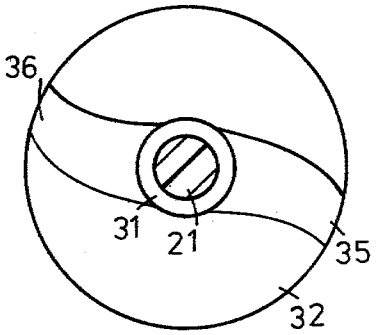
Fig. 2
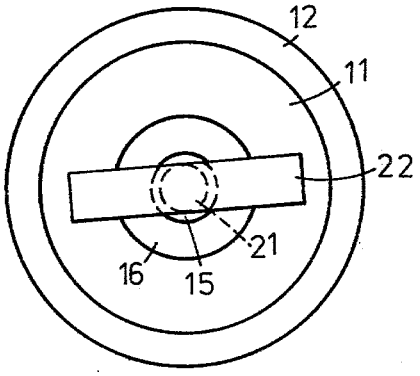
Fig. 3

ROTARY SPRINKLER

BACKGROUND OF THE INVENTION

The present invention relates to rotary sprinklers, and particularly to rotary sprinklers for use in water irrigation.

Many different types of sprinklers are presently used for water irrigation. Thus, there is the impact or hammer type sprinkler which produces a long-range jet rotating at a relatively low-velocity, e.g. in the order of up to 10 RPM. A second type, commonly called a whirling sprinkler, produces a shorter-range jet rotating much faster, in the order of several hundred RPM's. A third type, sometimes called a mini-sprinkler or sprayer, is a static device which produces no rotating jet but rather a spray of fine water droplets around the sprinkler. The present invention is particularly useful with respect to the latter two types of sprinklers.

The known devices, particularly the whirling-sprinkler or mini-sprinkler types, frequently suffer from high-sensivity to clogging by solid particles in the irrigation water, non-uniformity in the distribution of the water around the sprinkler particularly when they include lateral supporting elements impinged by the water, and/or the need for high precision in the dimensions of the parts of the sprinkler thereby increasing both the initial and the maintenance costs and reducing their useful lives by wear.

An object of the present invention is to provide a rotary sprinkler having advantages in the above respects as will be more particularly pointed out below.

BRIEF SUMMARY OF THE INVENTION

According to a broad aspect of the present invention, there is provided a rotary sprinkler comprising a nozzle connectable to a liquid supply pipe and having an axial bore for issuing the liquid through its outlet end in the form of a jet; a spindle extending through the bore and projecting outwardly of its outlet end, and a rotor floatingly mounted on the spindle for rotary and axial movement thereon, the outward movement being limited by an outer stop on the spindle. The rotor includes a surface to be impinged by the liquid jet issuing from the bore and configured to impart a rotary movement to the rotor on the spindle. Further, the spindle has a smaller outer diameter than the diameter of the bore and is laterally movable within the bore, the arrangement being such that the rotation of the rotor by the liquid jet self-centres the spindle in the bore of the nozzle.

In the preferred embodiment of the invention described below, the spindle is of longer length than that of the bore and is axially, as well as laterally, movable therein, the spindle further including an inner stop engageable with the nozzle for limiting the outward movement of the spindle with respect to the bore.

According to a further important feature in the described preferred embodiment, the rotor is formed with a central bore receiving the outer end of the spindle which bore is of larger diameter than that of the spindle outer end. The arrangement is such that the rotation of the rotor by the water jet is effective not only to self-centre the spindle in the bore, but also to self-centre the rotor on the spindle. The rotor further includes an outer sealing surface effecting a substantially sealing engagement with the outer stop on the spindle.

Rotary sprinklers constructed in accordance with the foregoing features provide a number of important advantages. Thus, since the spindle is movable laterally within the nozzle bore and is automatically self-centred by the rotation of the floatingly-supported rotor, a high uniformity in the distribution of the water about the sprinkler is achieved. In addition, the movement, both lateral and axial, of the spindle in the nozzle bore effects a continuous cleaning of the nozzle bore, thereby reducing its sensitivity to clogging. Further, the floating movement of the rotor on the spindle similarly effects a self-cleaning of the rotary mounting of the rotor, and reduces the sensitivity of binding the rotor on the spindle. Also, making the rotor bore of large diameter than its spindle mounting produces a water bearing between the rotor and spindle substantially reducing the friction between the two during the rotation of the rotor. Further, when the device is not in operation, the rotor drops by gravity to cover the nozzle bore, thereby minimizing the clogging of the nozzle bore by the accumulation of dirt or insects. Still further, the spraying device does not require any lateral supporting elements, and therefore can effect a complete 360° distribution of the water about the device. Finally, because of the permissible movements of the parts and the automatic self-centring action by the rotation of the rotor, the need for critical dimensioning of the parts is substantially reduced, thereby permitting the use of simple parts which can be readily produced in volume and at low cost (e.g. by injection molding) and which can be assembled quickly and inexpensively to provide a low-cost, efficient rotary sprinkler of sturdy and dependable construction and having a long useful life.

Further features and advantages of the invention will be apparent from the description below.

BRIEF DESCRIPTION OF THE DRAWINGS

The invention is herein described, by way of example only, with reference to the accompanying drawings, wherein:

FIG. 1 is a longitudinal sectional view illustrating one form of rotary sprinkler constructed in accordance with the invention;

FIG. 2 is a sectional view along lines II—II of FIG. 1; and

FIG. 3 is a bottom plan view of the device of FIG. 1.

DESCRIPTION OF A PREFERRED EMBODIMENT

The rotary sprinkler illustrated in the drawings is particularly useful for mounting directly onto a water supply pipe (not shown) by friction-fitting the device into an apertured wall of the supply pipe.

The illustrated device comprises three main parts, namely: a nozzle, generally designated 10, a spindle, generally designated 20; and a rotor, generally designated 30. Briefly, when the nozzle 10 is mounted within the apertured wall of the water supply pipe, the spindle 20 is both axially and laterally movable within the nozzle bore, and the rotor 30 is also axially and laterally movable on the spindle. The arrangement is such that the rotation of the rotor by the water jet issuing from the nozzle bore self-centres the rotor on the spindle, and also self-centres the spindle within the nozzle bore.

More particularly, the nozzle 10 is formed with an outer tapered face 11 for reception, by a friction-fit, into the apertured wall of the water supply pipe (not shown). The nozzle further includes an enlarged head 12 having an inner annular face 13 engageable with the outer face of the water supply pipe so that, when the nozzle is inserted into its apertured wall, the head 12 projects exteriorly of the pipe. The outer face of nozzle 10 is preferably flat, as shown at 14. Nozzle 10 is further formed with an axial bore 15 extending through it to its outer face 14, the inner end of bore 15 being of enlarged diameter as shown at 16.

Spindle 20 includes a cylindrical section 21 passing through bore 15 of the nozzle 10, and having a length substantially longer than the nozzle so as to project outwardly of both ends. In addition, cylindrical section 21 of spindle 20 has an outer diameter less than the diameter of bore 15, so that the spindle is both axially and laterally movable within the bore. The inner end of spindle 20 includes a cross-bar 22 of longer length than the diameter of the lower end 16 of bore 15 so as to limit the outward movement of the spindle with respect to the bore. The outer end of the spindle carries an outer stop element 23, of substantially button-shape, formed with a blind bore for receiving the outer end of the spindle section 21 with a friction-fit. The lower face of stop element 23 is flat and smooth as shown at 24.

Rotor 30 is also formed with an axial bore 31 of large diameter than the outer diameter of the cylindrical section 21 of spindle 20, so that the rotor is floatingly mounted on the spindle, and is movable both axially and laterally of the spindle as it rotates thereon. The rotor 30 is of circular section, but its underface 32 impinged by the water issuing from nozzle bore 15, is tapered to provide an increase in diameter toward its upper end, i.e. in the direction away from the nozzle 10. The upper face 33 of the rotor 30 may be curved, as shown in FIG. 1. This upper face is formed with an annular smooth, flat bead 34 surrounding its central bore 31 and projecting axially for engagement with the outer flat face 24 of stop 23 on the spindle 20.

The lower tapered face 32 of the rotor is provided with means for imparting a rotary movement to the rotor when impinged by the water jet issuing from nozzle bore 15. The latter means is illustrated in FIGS. 1 and 2 as in the form of a pair of deep grooves 35, 36, extending from the central bore 31 of the rotor to its outer edge. As shown particularly in FIG. 2, both grooves 35 and 36 are curved in the circumferential direction at their outer ends to impart a rotary movement to the rotor when impinged by the water jet from nozzle bore 15.

When the device is to be used, it is assembled as shown in FIG. 1 and friction-fitted into the apertured wall of a water supply pipe, whereupon it operates in the following manner:

First, when the water supply is turned off, rotor 30 will drop by gravity onto face 14 of nozzle 10. Spindle 20 will also drop by gravity with the flat face 24 of its outer stop 23 engaging the outer face of bead 34 on the rotor 30, thereby effectively closing-off the open end of the nozzle bore 15 against the entry of dirt or insects.

When the water supply is turned on, the water passes through bore 15 and issues in the form of an annular jet around spindle section 21, to impinge the lower surface 32 of rotor 30, thereby lifting the rotor 30 against the upper spindle stop 23. This also lifts the spindle 20 until its lower stop 22 engages the lower face of the nozzle 10.

The water impinging face 32 of rotor 30 enters grooves 35, 36 and thereby imparts a rotary movement to the rotor, by virtue of the curved ends of these grooves so that the rotor rotates to produce two rotating jets, thereby distributing the water 360° laterally around the device. During this rotation of rotor 30, the flat, smooth face of its bead 34 is brought into contact with the flat, smooth face 24 of the outer stop 23 on the spindle 20, effectively sealing the rotor bore 31 against the flow of water therethrough.

It has been found that the rotation of the rotor 30 self-centres it on the spindle 20, and in addition self-centres the spindle with respect to the nozzle bore 15. Accordingly, a uniform distribution of the water is produced 360° around the device. It has also been found that the axial movement of the rotor 30 on the spindle 20, and the axial movement of the spindle within the nozzle bore 15, during starting and stopping of the sprinkling operation, and also the lateral movement of both during their self-centring, maintain bore 15 through the nozzle 10 substantially free of foreign particles, thereby substantially reducing the sensitivity of the device to clogging. Moreover, it has been found that the rotor rotates on a film of water, and that its axial and lateral movements with respect to spindle 20 also keep bore 31 through the rotor free of foreign particles.

It will be appreciated that the configuration of the underface 32 of rotor 30 determines to a large extent the type of water distribution effected by the sprinkler. Thus, the same sprinkler could be supplied with a number of differently configured rotors 30 so as to change the distribution pattern by merely substituting the appropriate rotor for the particular pattern desired. For example, if a short distribution of finer droplets is desired, comparable to what is obtained by the mini-sprinkler or static-type spray nozzle, the lower face 32 of rotor 30 may be formed with a larger number of shallow grooves or recesses; and if a longer throw of larger droplets is desired, the lower face 32 may be formed with deeper grooves.

While the invention has been described with respect to one preferred embodiment, it will be appreciated that many variations, modifications and other applications of the invention may be made.

What is claimed is:

1. A rotary sprinkler comprising:

a nozzle connectable to a liquid supply pipe and having an axial bore for issuing the liquid through the outlet end thereof in the form of a jet;

a spindle extending through the bore and projecting outwardly of the outlet end thereof;

a rotor floatingly mounted on the spindle for rotary and axial movement thereon;

an outer stop on said spindle limiting the outward movement of the rotor thereon;

said rotor including a surface to be impinged by the liquid jet issuing from said bore and configured to impart a rotary movement to the rotor on the spindle;

said spindle having a smaller outer diameter than the diameter of said bore and being laterally movable within said bore; and means maintaining the spindle within said bore while allowing lateral movement thereof within the bore, such that the rotation of the rotor by the liquid jet self-centres the spindle in said bore of the nozzle.

2. A sprinkler according to claim 1, wherein said spindle is of longer length than said bore and is axially as well as laterally movable therein, and spindle maintaining means including an inner stop engageable with said nozzle for limiting the outward movement of the spindle with respect to said bore.

3. A sprinkler according to claim 1, wherein said rotor is formed with a central bore receiving the outer end of said spindle and of larger diameter than that of said spindle outer end, the rotation of the rotor by the water jet also being effective to self-centre the rotor on the spindle, said rotor further including an outer surface effecting a substantially sealing engagement with said outer stop on the spindle.

4. A sprinkler according to claim 3, wherein said outer stop on the spindle is formed with a blind opening friction-fitted into the outer end of the spindle.

5. A sprinkler according to claim 4, wherein said outer sealing surface on the rotor is an annular bead surrounding its central bore and projecting axially thereof for engagement with the outer stop of said spindle.

6. A sprinkler according to claim 5, wherein the outer surface of the annular bead on the rotor, and the confronting face of said outer stop on the spindle, are both flat and smooth to effect a substantially sealed, rotary-bearing engagement therebetween.

7. A sprinkler according to claim 3, wherein said rotor surface impinged by the liquid jet includes at least one groove extending from the apertured centre of the rotor to the outer edge thereof, said groove being curved in the circumferential direction at its outer end so as to impart a rotary motion to the rotor when impinged by the liquid jet.

8. A sprinkler according to claim 3, wherein said rotor is of circular section and its surface impinged by the water jet is outwardly tapered to provide an increase in diameter in the direction away from said nozzle.

9. A sprinkler according to claim 1, wherein said nozzle includes a conical outer wall enabling same to be friction-fitted into an apertured wall of the supply pipe.

10. A sprinkler according to claim 1, wherein the surface of said nozzle facing the rotor is substantially flat.

* * * * *